US005463272A

United States Patent [19]

Watase et al.

[11] Patent Number: 5,463,272

[45] Date of Patent: Oct. 31, 1995

[54] CATHODE FOR PHOTOELECTRIC EMISSION, CATHODE FOR SECONDARY ELECTRON EMISSION, ELECTRON MULTIPLIER TUBE, AND PHOTOMULTIPLIER TUBE

[75] Inventors: Yasushi Watase; Masao Kinoshita; Hiroyuki Watanabe; Takeo Hashimoto; Takehiro Iida; Hiroaki Washiyama, all of Hamamatsu, Japan

[73] Assignee: Hamamatsu Photonics K.K., Hamamatsu, Japan

[21] Appl. No.: 130,897

[22] Filed: Oct. 4, 1993

[30] Foreign Application Priority Data

Oct. 5, 1992 [JP] Japan ..... 4-266235

[51] Int. Cl.[6] ..... H01J 1/32

[52] U.S. Cl. ..... 313/373; 313/377

[58] Field of Search ..... 313/373–379, 313/523–527; 250/214 VT; 348/216–217

[56] References Cited

U.S. PATENT DOCUMENTS

| | | | |
|---|---|---|---|
| 3,809,941 | 5/1974 | Bourg et al. | 313/94 |
| 3,988,497 | 10/1976 | Asakura | 428/409 |
| 4,131,820 | 12/1978 | Washida | 313/377 |
| 4,160,185 | 7/1979 | Tomasetti et al. | 313/94 |
| 4,935,617 | 6/1990 | Anno et al. | 250/213 VT |
| 4,985,773 | 1/1991 | Gilligan et al. | 348/217 |

FOREIGN PATENT DOCUMENTS

| | | |
|---|---|---|
| 4922858 | 6/1972 | Japan . |
| 1503875 | 3/1978 | United Kingdom . |

OTHER PUBLICATIONS

Chabrier et al., Acta Electronca, vol. 16, 2, 1973, pp. 203–210.

Sommer, Photosensitive Materials, Preparation, Properties, and Uses, Robert E. Krieger Publishing Company, 1980, pp. 52–53, 118–121.

Patent Abstracts of Japan, vol. 013, No. 017 (P-813) 17 Jan. 1989 & JP-A-63 221 279 (Hamamatsu) 14 Sep. 1988 *abstact*.

Patent Abstracts of Japan, vol. 014, No. 576 (E-1016) 21 Dec. 1990 & JP-A-02 250 232 (Matsushita) 8 Oct. 1990 *abstract*.

*Primary Examiner*—Stephen Brinich

*Attorney, Agent, or Firm*—Cushman, Darby & Cushman

[57] ABSTRACT

A cathode for photoelectric emission or a cathode for secondary electron emission comprises a thin film made of a material which emits photoelectrons by an incident light or emits secondary electrons by an electron input on a base substrate. The average particle size of the particles forming the thin film is 200 nm to 2000 nm. It is preferred that the average particle size is nearly equal to an average diffusion length of the particle of an excited electron. Further, the average particle size is preferably larger than the mean value of penetration lengths of inputted electrons or incident lights in the particles. Moreover, preferably convexities and/or concavities formed of particles each having the average particle size are formed over the surface of a plane for the incident light or electron input. Further, it is preferred that the thin film is activated by an alkali metal and is made of compounds of at least one kind of alkali metal and an antimony metal. Moreover, a layer having high reflectance against light is preferably inserted between the base substrate and the thin film. Thus, according to the cathode for photoelectric emission or the cathode for secondary electron emission, photoelectrons or secondary electrons are generated effectively and emitted from the cathode for photoelectric emission or the cathode for secondary electron emission.

13 Claims, 6 Drawing Sheets

CATHODE FOR PHOTOELECTRIC EMISSION, CATHODE FOR SECONDARY ELECTRON EMISSION, ELECTRON MULTIPLIER TUBE, AND PHOTOMULTIPLIER TUBE

BACKGROUND OF THE INVENTION

1. Field of the Invention

This invention relates to an electron emitting cathode for emitting photoelectrons or secondary electrons, which may suitably be used in a photomultiplier tube or other devices.

2. Related Background Art

A photocathode has a characteristic that its electron emission efficiency differs for the polarization state of the incident light even if the intensity of the incident light is the same. This is because photoelectric emission depends on an angle between the photocathode and the plane of polarization of light, hereinafter referred to as a characteristic of polarization of light. In the measurement of light, the intensity of incident light is usually one feature that is measured so that the characteristic of the photocathode is disadvantaged. In order to avoid this disadvantage, the photocathode is formed of an aggregate of small particles, and a surface of the photocathode is made to form a variety of angles against a plane of polarization of incident light. Then, the characteristic of polarization of light is practically eliminated for the entire photocathode. More particularly, the layer of solid structure formed by a large number of microscopic particles similar to a cavernous body, which has hollow inside, is formed on an electrode. A photocathode comprising one or plural alkali metal(s) and an antimony metal is appreciated as an electron emitting cathode to be used in a phototube or photomultiplier tube. Hence the photocathode may also be operated as a secondary electron emitting cathode, this is used as a dynode of a photomultiplier tube or secondary-electron multiplier tube. The difference between photoelectric emission phenomenon and secondary electron emission phenomenon is that a cause of electric emission is respectively an incident light and an electron input, although basically most characteristics of these phenomena are in common.

More particularly, for example, for a 1 (⅛) inch photomultiplier tube, an Sb layer having a thickness of about 2000 angstroms is deposited on a surface of a Ni base substrate as a photocathode, and it is activated with an alkali metal. Here, in case of a bialkali photocathode, its luminous sensitivity is 30–70 μA/lm and in case of a multialkali photocathode, 50–100 μA/lm is obtained. An Al base substrate has been developed to improve the sensitivity, and its luminous sensitivity is increased to 200 μA/lm. The following literature is cited as a reference relating to the Al base substrate.

"Photoemissive Materials" by A. H. SOMMER (JOHN WILEY & SONS. INC. 1968)

Further, as a photocathode having another structure, a photocathode formed by depositing an $Al_2O_3$ layer and an Sb layer on a Ni base substrate is disclosed in U.S. Pat. No. 4,160,185 by RCA INC. Here, the $Al_2O_3$ layer has a function of preventing the Ni base substrate and Sb from alloying. Further, a structure made by forming a porous Sb layer on an Al base substrate through a solid-Sb layer is disclosed in GB Patent No. 1,503,875 by RCA INC. Moreover, in order to improve the sensitivity to long wavelengths, a structure comprising a photocathode placed on an Al layer with a pattern of islands, stripes or slits is disclosed in Japanese Laid-Open Patent Application No. 22858/1974.

SUMMARY OF THE INVENTION

An object of this invention is to provide a cathode for photoelectric emission or a cathode for secondary electron emission by eliminating a cause of deterioration of quantum efficiency and improving the quantum efficiency.

A cathode for photoelectric emission or a cathode for secondary electron emission according to this invention comprises a thin layer on a base substrate, and the average size of particles forming the thin layer is 200 nm to 2000 nm. It is preferred that the average particle size is nearly equal to an average diffusion length of an excited electron generated by an incident light or an electron input, and convexities and/or concavities are formed of particles each having the above-mentioned average particle size on the surface of the thin layer. Further, it is preferred that the average particle size is larger than the mean value of penetration lengths of incident lights or electrons in the particles. Here, the thin film as described above may be activated by an alkali metal, or it is preferably formed of a compound of at least one kind of alkali metal and an antimony metal. Moreover, it preferably contains a layer having high reflectance against light between the base substrate and the thin film.

In general, photoelectric emission phenomenon occurs through the following three steps:

① Step of exciting electrons inside of particles by optical absorption at the particles forming the photocathode;

② Step of transferring excited electrons to surfaces of particles;

③ Step of escaping electrons from the surfaces of particles to a vacuum.

Here, transferring step ② is mainly caused by electron diffusion, and the electrons are considered to be moved statistically in a length of about the average diffusion length from the generated position. Accordingly, the excited electrons generated a far distance from the surfaces of particles, among excited electrons according to the exciting step ①, lose their energies before reaching the surfaces of particles through the transfer process, and they cannot contribute to photoelectric emission. Further, most of the electrons on which the collecting electric field of the anode does not act effectively, among electrons emitted to a vacuum of spaces between particles from the surfaces of particles placed at deep position from the surface of photocathode, lose their energies by collision with particles disposed in the neighborhood, and the electrons are eliminated by recombining with holes. Then, such electrons cannot contribute to photoelectric emission. Therefore, according to the present inventor's study, in order to improve the photoelectron emission efficiency, (i.e., a quantum efficiency), it is necessary to make optical absorption larger in particles disposed at the surface of the photocathode, and the optical absorption is caused to occur in the range of the average diffusion length, (i.e., an escaping length), from the particle emitting plane.

FIG. 1 shows an example of a cathode for photoelectric emission or a cathode for secondary electron emission comprising a layer 5 formed of particles of small size. As shown in the figure, the layer 5 made of a large number of particles is formed on a base electrode 4.

FIG. 2 shows a magnified sectional diagram taken in the line a—a' of the structure shown in FIG. 1, which is used for explaining the function of photoelectric emission. As shown in FIG. 2, when an incident light 1 which is a light to be detected is inputted to a surface *6a* of a photocathode for photoelectric emission, the partial incident light becomes a reflected light 2 as it is reflected at the surface 6, and it is diverged without inputting to the photocathode for photoelectric emission. Because of this, the reflected light 2 does not contribute to photoelectric emission. Further, a partial light 3*a* inputted to the inside of the photocathode 5 for photoelectric emission excites an electron 4*a* inside of the particle on the surface of photocathode. A light 3*b* passed through the particles on the surface without absorption excites an electron 4*b* inside of the particle at deep position from the surface. The electron 4*b* excited at deep position is emitted to the vacuum of space between particles, but the electron 4*b* loses its energy by collision with particles disposed around the particle from which the electron 4*b* is emitted. Then, it cannot contribute to photoelectric emission. Similarly, in the secondary electron emitting cathode, the excited electron emitted from a particle disposed at a deep position from the surface cannot contribute to secondary electron emission.

Because of the reason described above, a cathode for photoelectric emission or a cathode for secondary electron emission formed of a large number of particles each having a small particle size has a structure such that photoelectrons generated from particles at a deep position from the surface cannot reach the surface of the photocathode and cannot contribute to photocurrent. This structure makes the quantum efficiency lower.

According to this invention, an average particle size of particles forming a thin film for electron emission is nearly equal to an average diffusion length of an excited electron. On the surface of the thin film, convexities and/or concavities may be formed by particles having an average particle size of 200 to 2000 nm. For this reason, the characteristic of polarization against the incident light into the photocathode is practically eliminated. The incident light or primary electron is absorbed by particles forming the first layer and second layer of the surface. Therefore, electrons excited and generated from the particles can contribute to photoelectron or secondary electron emission.

Further, a layer having high reflectance against lights may be disposed between the base substrate and the thin film. Such a structure promotes high sensitization of the resultant device and prevents the basic substrate and the photocathode from alloying, thereby forming a photocathode which has good crystallization.

In a cathode for photoelectron or secondary electron emission according to the present invention, a plane for inputting lights or primary electrons may comprise a compound of one or plural alkali metal(s), and an antimony metal, and the average particle size is made to be nearly equal to the average diffusion length of the excited electron. Therefore, reflectance against the light inputted to the surface of the photocathode or reflectance against the primary electron inputted to the surface of the photocathode can practically be lower, and excited and generated photoelectrons or secondary electrons can be emitted from a plane other than the inputting plane. Then, electron emission efficiency can remarkably be improved.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

This invention will be explained below in more detail with reference to the accompanying drawings.

Figure 3:
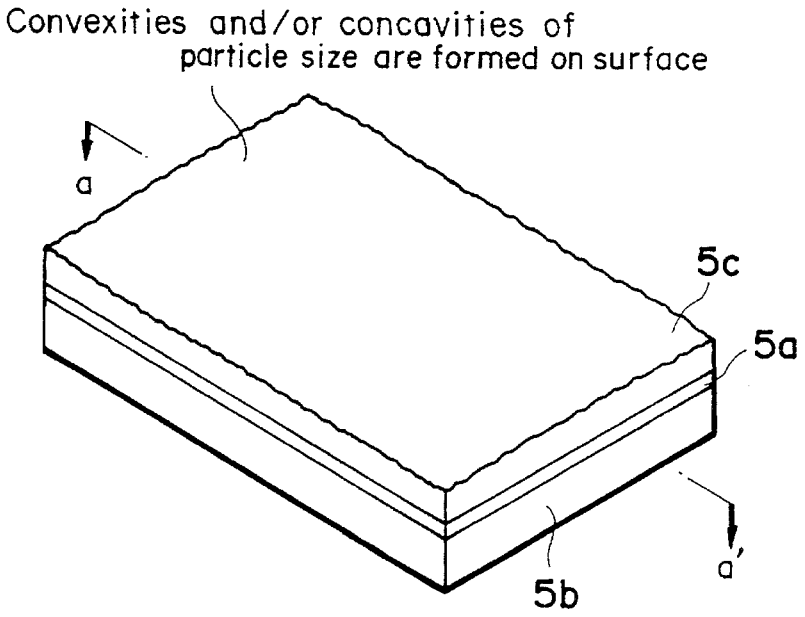
FIG. 3 is a schematic perspective view of a cathode for photoelectron or secondary electron emission according to an embodiment of the present invention.

FIG. 3 shows a cathode for photoelectric emission according to an embodiment of the present invention. Particles 5*c* formed of a compound comprising a cesium metal, sodium metal, potassium metal and antimony metal are deposited on a nickel electrode substrate 5*b* covered by an aluminum metal layer 5*a*. In this embodiment, the above-mentioned particles have an average particle size of 500 nm, and an average height from concave parts to top of convex parts is approximately 1000 nm, and an average space between a particle on the convex part and a particle on the neighboring convex part is approximately 1000 nm. A multialkali photocathode formed of plural particles can be formed by an ordinary vapor deposition technique wherein a film of antimony particles is deposited in hydrogen gas or inert gas such as an argon, and neon, is reacted with vapor of alkali metal.

Further, a scanning electron microscope which is commonly used in observation and measurement of microscopic structure is used for observation and measurement of the average particle size of particles of this embodiment. A substance including an alkali metal element usually has a characteristic that it reacts with water vapor or oxygen to provide an oxide or hydroxide. If such a reaction is slight, the reaction is restricted within a surface area of particles and their shapes can be kept substantially unchanged. However, in case of reaction with water vapor or oxygen in atmosphere, the reaction occurs not only in the surface area of particles but also in the inside thereof to change the shapes of particles. In order to avoid such deformation, a substance including an alkali metal element is handled in inactive gas atmosphere or vacuum, and they are set in the scanning electron microscope without exposure to the atmosphere. In this embodiment, in a sample observation chamber of a scanning election microscope, the multialkali photocathode was taken from its vacuum container in vacuum atmosphere and then subjected to observation and measurement. At this time, the degree of vacuum was approximately $3\times10^{-4}$ pascal. The average particle size was given by the mean value of particle sizes of 500 to 1000 particles.

The shape of convexity and/or concavity was measured by a method using a scanning electron microscope. The average height from the concave parts to the top of the convex parts and the average space between the particle on the convex part and the one on the neighboring convex part were given by the mean value of those of 200 to 500 samples.

Figure 4:
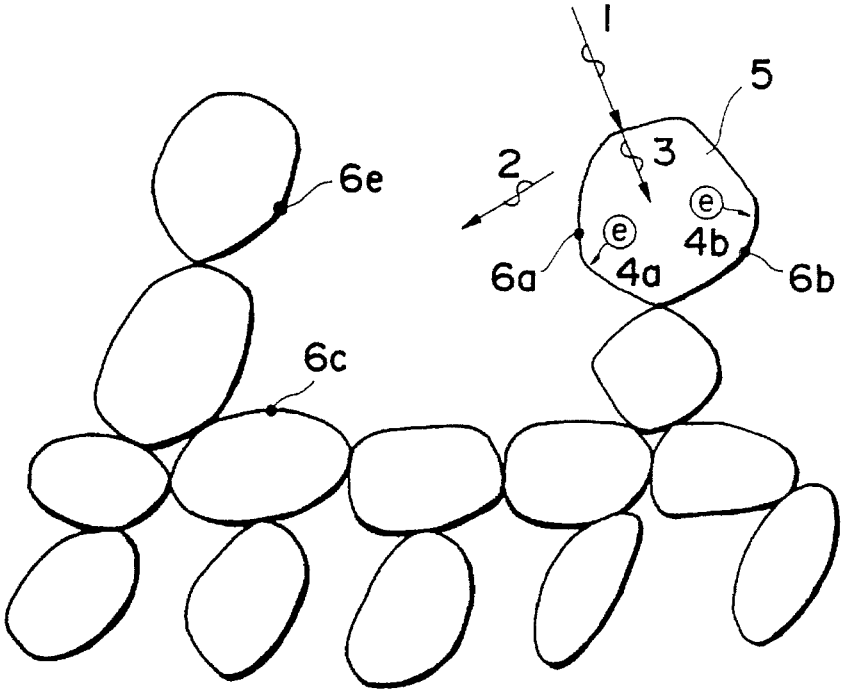
FIG. 4 is a schematic view of a magnified section of a cathode for photoelectron or secondary electron emission, which is used for explaining the function of photoelectric emission according to an embodiment of the present invention.

FIG. 4 shows a sectional diagram of a—a' of FIG. 3, and shows a case wherein a light is inputted to a photocathode. The mechanism of secondary electron emission will be explained below with reference to FIG. 4.

Photons 1 obliquely inputted to the photocathode for photoelectric emission having such a shape shown in FIG. 4 are split into photons 3 going to the inside of a photocathode 5 and photons 2 reflecting at the surface. Since the photoabsorption coefficient of a multialkali photocathode is approximately $5\times10^{4}$ $cm^{-1}$, when the inputted photons 3 advance about 500 nm in the photocathode, nine of ten photons are absorbed. Accordingly, the inputted photons 3 are substantially absorbed by the particles to which the photons are inputted, and excite electrons 4*a* and 4*b* inside of the particles of the photocathode. The excited electron 4*b* generated at a far position from the escaping length as seen from a side plane 6*a* is emitted from the side plane 6*b* positioned within the range of escaping distance counted from the electron 4*b* and then contributes to photoelectric emission.

The reflected light 2 is inputted to the surface 6*c* of the concave part, and the partial light causes photoelectric emission through the steps as described above. The light reflected at the surface of the convex part is reentered to a side plane 6*e*, and the partial light causes photoelectric emission through the steps as described above. Thus, the incident light is absorbed by the surface of photocathode and then contributes to photoelectric emission.

Figure 2:
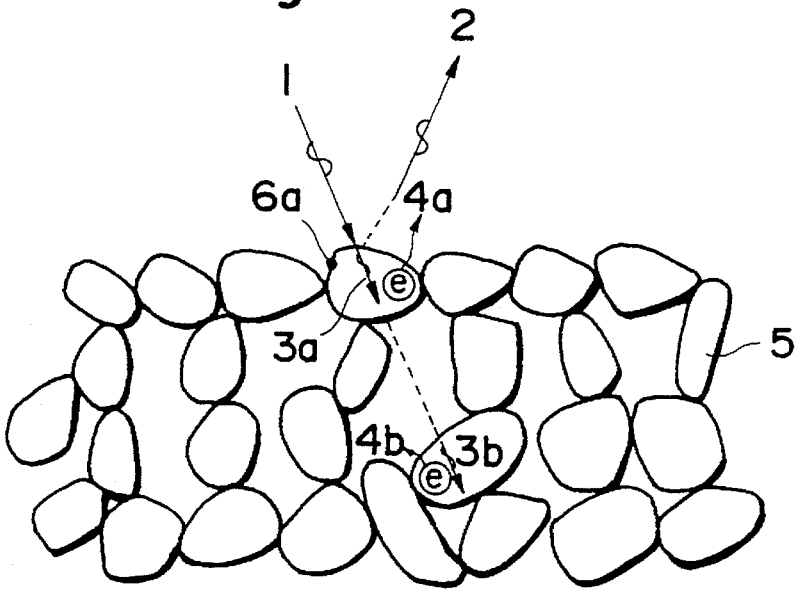
FIG. 2 is a schematic view of a magnified section of a conventional cathode for photoelectron or secondary electron emission taken in the line a—a' of FIG. 1, which is used for explaining the function of photoelectric emission.

On the other hand, for the conventional photocathode, the particle size is approximately 30 nm, and the inputted photons 3 of FIG. 2 are absorbed by the particles of the first layer of the photocathode and then contribute to photoelectric emission. The amount of light absorbed by this layer is only about 15 percent, which makes a small contribution. The light 3*b* which is not absorbed by the layer is absorbed by the particles at a deep position and excites the electron 4*b*. The electrons excited at the deep position are emitted to the vacuum of spaces of particles from the surfaces of particles, but their energies are lost by collision with particles disposed around the particle from which the electrons are emitted, and they recombine with holes. Then, the electrons disappear and cannot contribute to photoelectric emission. In the photocathode of the present invention, photoelectron emission efficiency, that is quantum efficiency, is greater than that displayed in a conventional photocathode.

Figure 1:
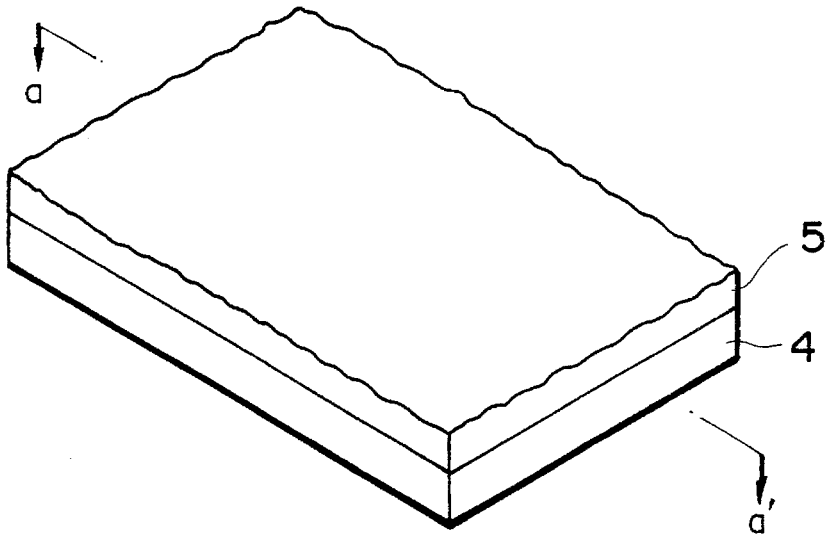
FIG. 1 is a schematic perspective view of an example of a conventional cathode for photoelectron or secondary electron emission.

In a cathode for secondary electron emission, if the electron inputting plane has a shape of convexity and/or concavity formed from an aggregate of particles as shown in FIG. 1, primary electrons reflected at the surface of the photocathode among the inputted primary electrons are inputted to the photocathode for secondary electron emission and can contribute to secondary electron emission. Further, secondary electrons can also be emitted from the plane other than the electron inputting plane. Then, the secondary electron emission efficiency becomes large. Here, in a multialkali photocathode formed of Na, K, Sb and Cs, when the average particle size is about 500 nm, the average diffusion length is about 500 nm, when the average particle size is about 300 nm, the average diffusion length is about 100 nm, and when the average particle size is about 30 nm, the average diffusion lengths is about 5 nm.

The electron diffusion length is obtained by curve-fitting based on the theory described in "G. Chabrier, P. Dolizy, et. al: ACTA ELECTRONCA, Vol. 16, 2, 1973 pp. 203–210", after lights are irradiated separately to the planes of both sides of the photocathode and the measurement of photocurrent for each case is finished.

Figure 5:
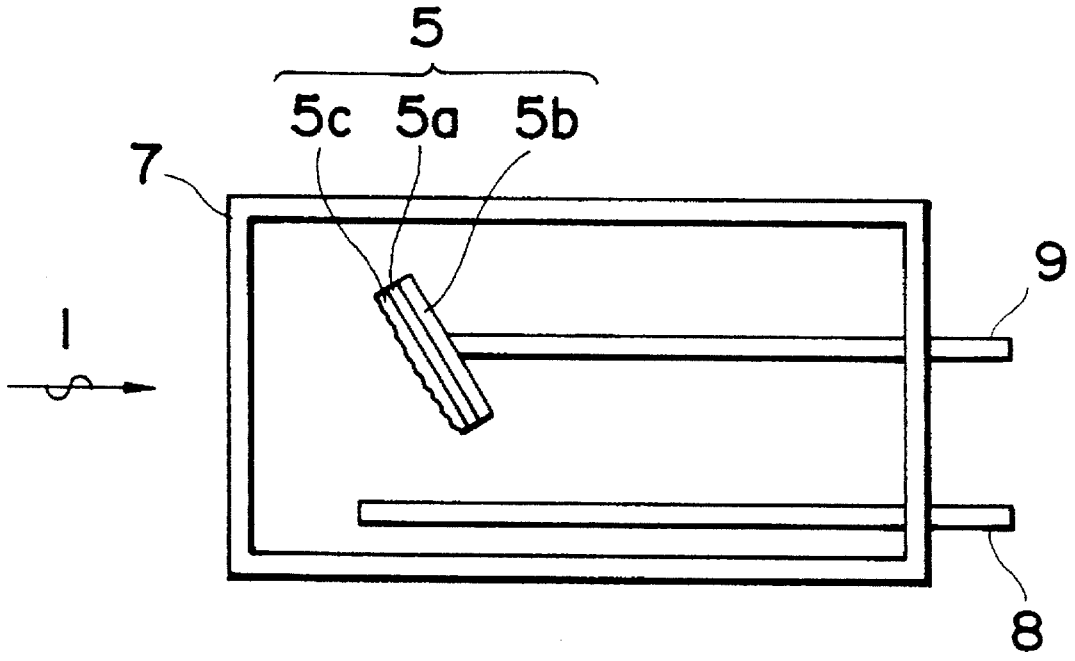
FIG. 5 is a schematic sectional view of a phototube using a cathode according to an embodiment of the present invention.

FIG. 5 shows a cross-sectional sketch of a phototube using the photocathode for photoelectric emission as a photocathode of a reflecting mode. Inside of a glass tube 7 as a vacuum container, there is disposed a photocathode 5 for photoelectric emission made of multialkali particles 5*c*, each having a size nearly equal to the average diffusion length of photoelectron, formed on the nickel electrode substrate 5*b* covered with an aluminum metal layer 5*a*, an anode 8 of a nickel metal, and a lead wire 9. Since the average diffusion length of photoelectron is about 500 nm, the average particle size of particles on the multialkali photocathode is made to be about 500 nm. A film of antimony particles deposited in hydrogen gas is reacted with vapor of an alkali metal to make the average particle size about 500 nm, the average height from the concave parts to the top of the convex parts approximately 1000 nm, and the average space between the particle on the convex part and the one on the neighboring convex part approximately 1000 nm.

The incident light 1 as a photon to be detected is inputted to the photocathode 5, and causes photoelectric emission to provide photocurrent, and then the photoelectron is collected by the anode 8. Here, the photocathode 5 which is formed of an aggregate of multialkali particles having the average particle size of 30 nm is used; on the other hand, the phototube including of the conventional photocathode and having the same structure as the phototube explained in the embodiment described above is used for comparison with the phototube of the embodiment.

Figure 6:
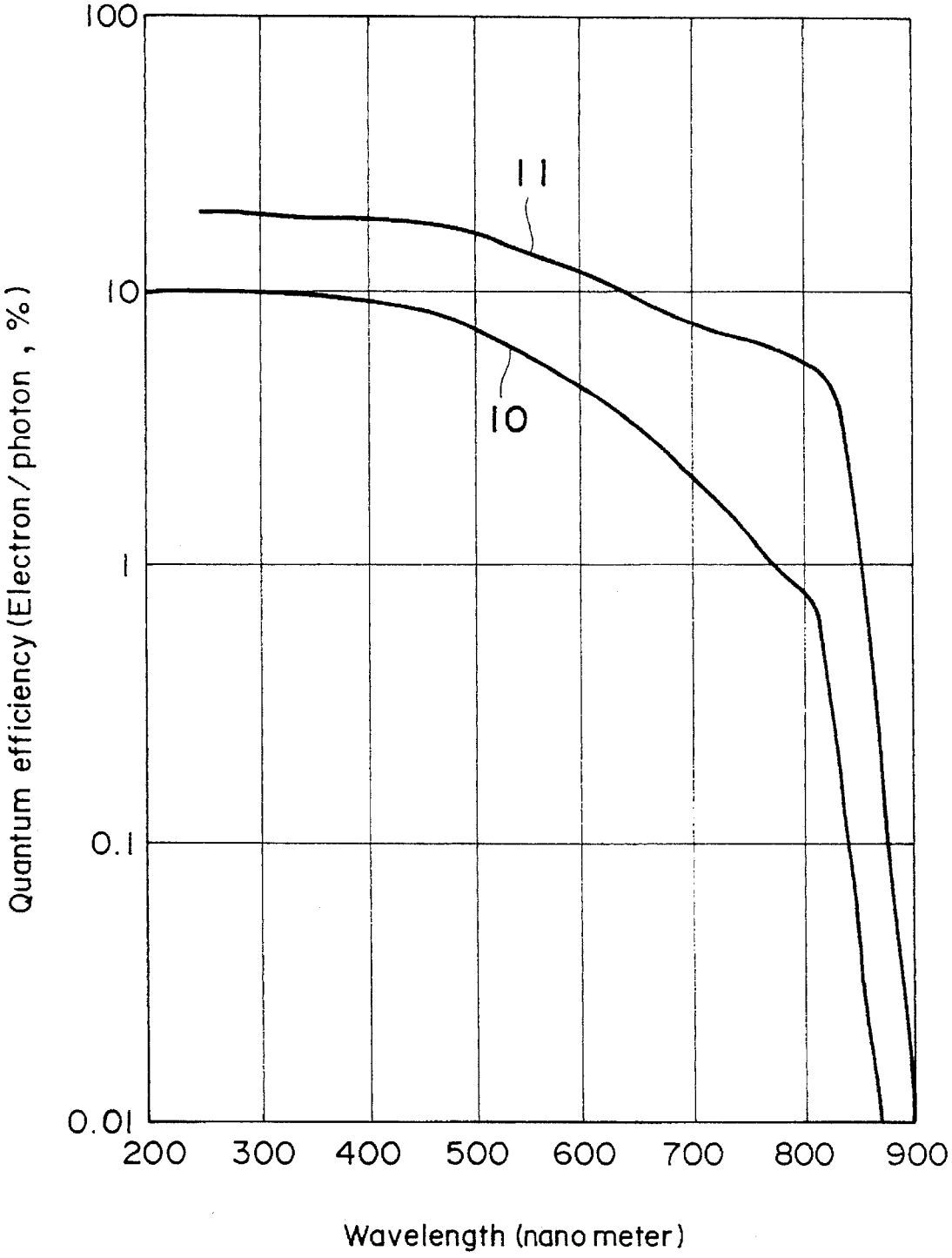
FIG. 6 is a graph of spectral sensitivity curves indicating quantum efficiency (10) of a conventional cathode for photoelectric emission and quantum efficiency (11) of a cathode for photoelectric emission according to the present invention.

FIG. 6 shows the comparison between quantum efficiency of the conventional example and quantum efficiency of the present invention. A curve 10 as shown in FIG. 6 is the curve indicating a spectral quantum efficiency of the conventional example, and a curve 11 shown in FIG. 6 is the curve indicating a spectral quantum efficiency of the present embodiment. According to this graph, it can be understood that the quantum efficiency is improved by about 30 percent for all wavelengths.

Figure 7:
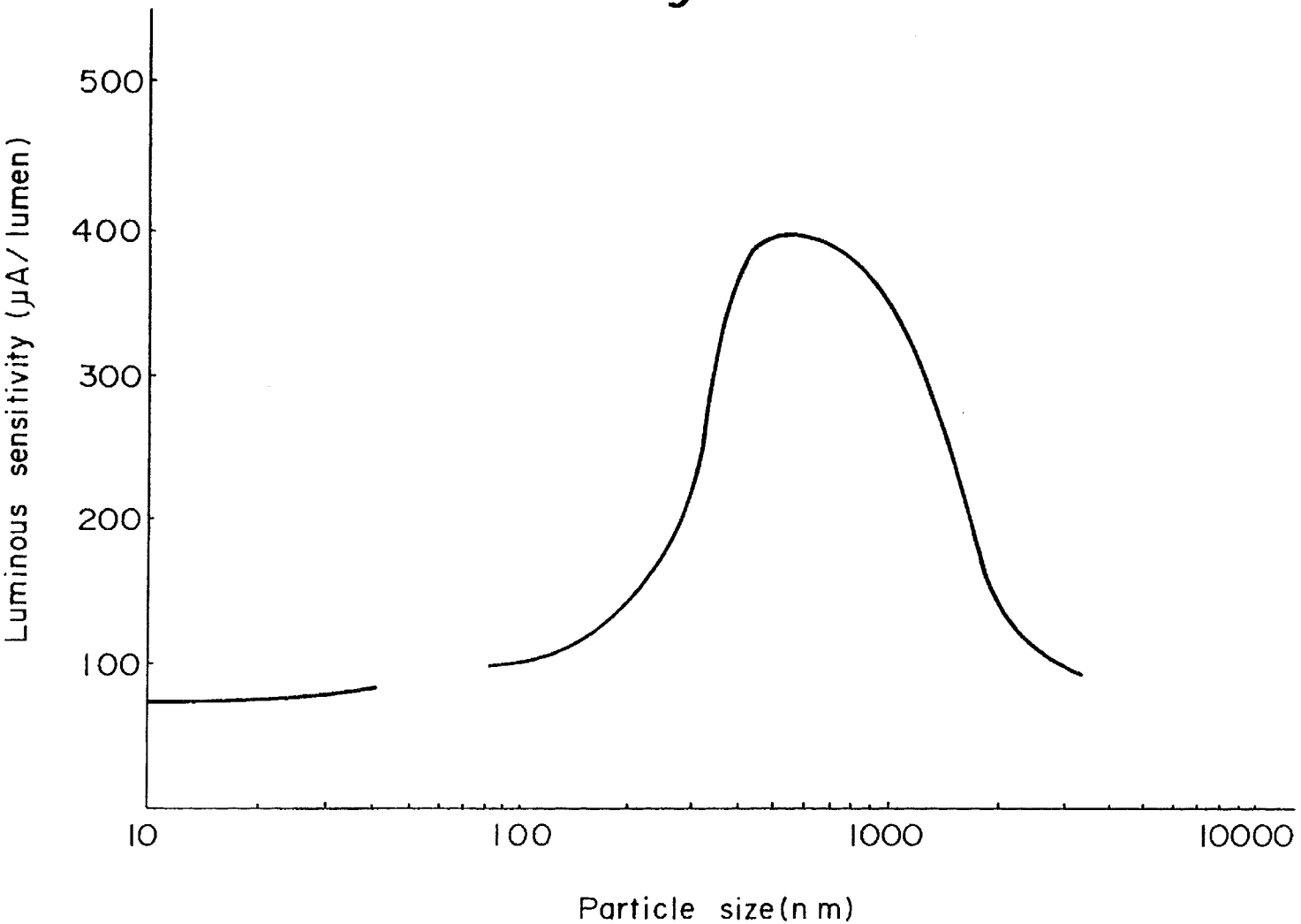
FIG. 7 is a graph showing a relation between a particle size and a luminous sensitivity of a cathode for photoelectric emission.

FIG. 7 shows a relation between the particle size of the photocathode and luminous sensitivity. From this figure, it can be understood that luminous sensitivity is remarkably improved at the particle size of 200 nm–2000 nm.

Figure 8:
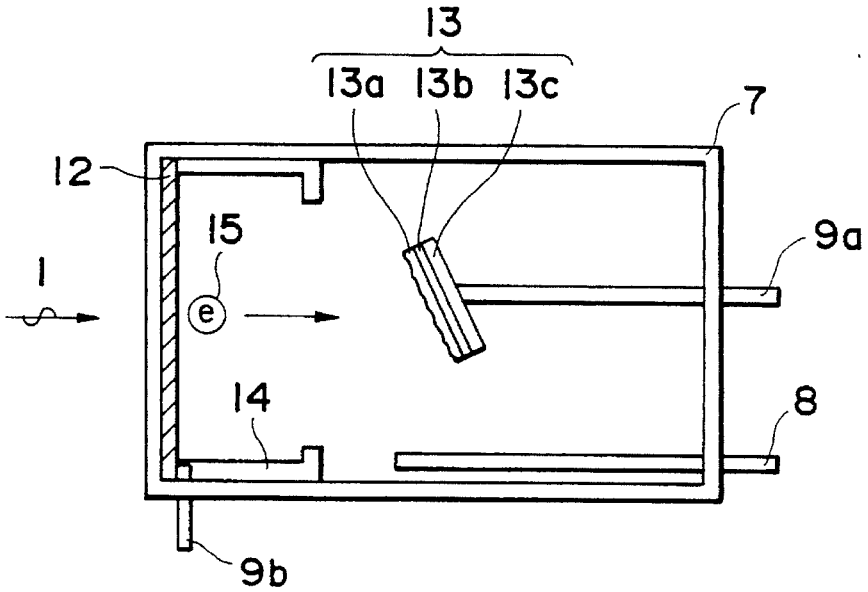
FIG. 8 is a schematic view of a section of a photomultiplier tube using a photocathode according to an embodiment of the present invention.

FIG. 8 shows a sectional sketch of the photomultiplier tube using the photocathode as shown in FIG. 5 as a dynode. A multialkali photocathode 12 is formed inside of the window area of a glass tube 7 forming a vacuum container. Further, the inside of the glass tube 7 comprises a photocathode 13 for secondary electron emission which comprises, multialkali particles 13*a* made of particles each having a size equal to the average diffusion length on a nickel electrode substrate 13*c* formed by deposition of an aluminum metal 13*b*, an anode 8 of a nickel metal, lead wires 9*a*, 9*b*, and a forcusing electrode 14.

Since the average diffusion length of photoelectron for the multialkali particle is about 500 nm, vapor of alkali metal is reacted with a film formed of antimony particles deposited in hydrogen gas to make the average particle size about 500 nm, the average height from the concave parts to a top of the convex parts about 1000 nm, the average space between the particle on the convex part and the particle on the neighboring concave part about 1000 nm. The incident light 1 as a light to be detected is converted into the photoelectron 15 by the photocathode 12. The photoelectron is accelerated, converged and inputted to the photocathode 13 for secondary electron emission. At this point, the photoelectron is amplified and collected by the anode 8. Hereinbelow the photomultiplier tube of this embodiment is compared with the photocathode for secondary electron emission formed of the aggregate of multialkali particles having the average particle size of approximately 30 nm and having the same shape as that of this embodiment.

Figure 9:
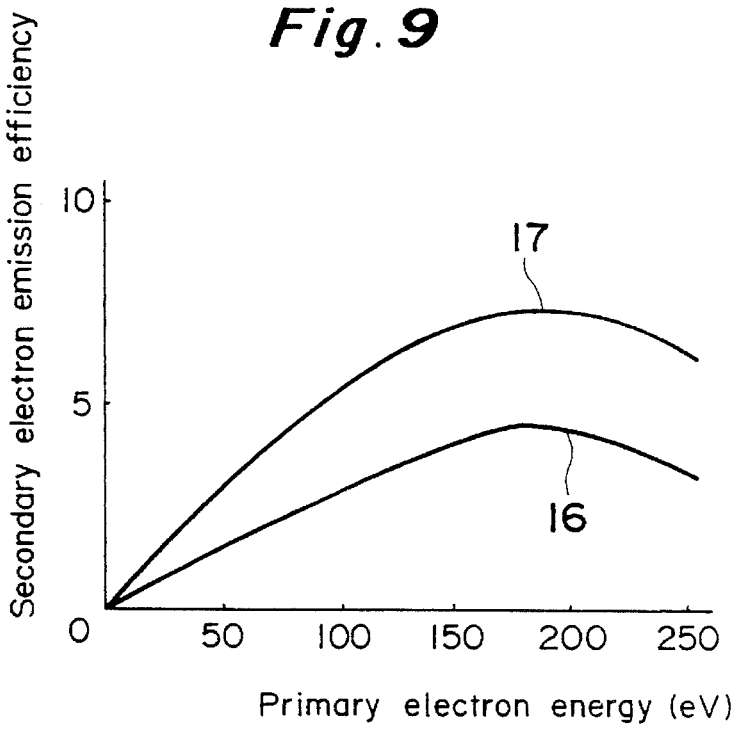
FIG. 9 is a graph comparing secondary electron emission efficiency (16) of a conventional cathode for secondary electric emission and secondary electron emission efficiency (17) using an electrode according to the present invention.

FIG. 9 shows a comparison between the secondary electron emission efficiencies for this embodiment and a conventional photomultiplier tube. The curve 16 as shown in this figure indicates the conventional secondary electron emission efficiency. The curve 17 indicates the secondary electron emission efficiency of this embodiment. From this graph, it can be understood that the secondary electron emission efficiency is remarkably improved.

As described above according to this invention, the photocathode made by forming an Al layer on a Ni base substrate, and forming a thin porous film Sb and an alkali metal has a sensitivity of 300–400 μA/lm, which shows remarkable improvement in its quality.

As a photocathode improved in its quality and having high sensitivity and reproducibility, there is a structure of base substrate formed by depositing a Cr layer and an Al layer on a Ni base substrate. Such a structure can prevent the Ni and Sb from reacting by inserting the Cr layer, and reflectance is enhanced by preventing dirts or scratches. In addition, a structure capable of completely preventing the Ni and Sb from reacting can be formed by oxidizing the surface of the Ni base substrate and forming an Sb photocathode thereon.

For obtaining high sensitivity of the device, the photocathode having the structure described above is very effective. The activating method (temperature, time, quantity of alkali metal, sequence and so on) for film material used in a photocathode may appropriately be selected.

Further, in order to obtain high sensitivity, it is preferred to coincide the photocathode plane and the dynode plane of the thin film at the highest sensitivity point. Because of this, the balance between the quantity of Sb and quantity of alkali metal may be optimized. The current dynode plane is formed of Ni and Sb, and of course the reaction between Ni and Sb occurs. Based on such a reaction, a suitable dynode plane can be formed. The reaction depends on the temperature and time.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A cathode for photoelectric emission comprising:

a base substrate; and a thin film formed on a surface of the base substrate and having a region for receiving an incident light, the thin film comprising a material for emitting photoelectrons in response to the incident light and including a plurality of particles, each having an average particle size of 200 nm to 2000 nm, which form convexities and/or concavities on the region.

2. A cathode for photoelectric emission according to claim 1, wherein the average particle size of the particles constituting the thin film is nearly equal to an average diffusion length of an electron excited by the incident light.

3. A cathode for photoelectric emission according to claim 1, wherein the average particle size of the thin film is larger than an average penetration length of the incident light in the thin film.

4. A cathode for photoelectric emission according to claim 1, wherein the thin film is activated by an alkali metal.

5. A cathode for photoelectric emission according to claim 1, wherein the thin film further comprises a compound of at least one kind of alkali metals and an antimony metal.

6. A cathode for photoelectric emission according to claim 1, further comprising a layer having a high reflectance against lights between the base substrate and the thin film.

7. A cathode for secondary electron emission comprising:

a base substrate; and a thin film formed on a surface of the base substrate and having a region for receiving an incident electron, the thin film comprising a material for emitting secondary electrons in response to the incident electron and including a plurality of particles, each having an average particle size of 200 nm to 2000 nm, which form convexities and/or concavities on the region.

8. A cathode for secondary electron emission according to claim 7, wherein the average particle size of the thin film is nearly equal to an average diffusion length of an electron excited by the incident electron.

9. A cathode for secondary electron emission according to claim 7, wherein the average particle size of the thin film is larger than an average penetration length of the incident electron in the thin film.

10. A cathode for secondary electron emission according to claim 7, wherein the thin film is activated by an alkali metal.

11. A cathode for secondary electron emission according to claim 7, wherein the thin film further comprises a compound of at least one kind of alkali metals and an antimony metal.

12. An electron multiplier tube comprising:

a vacuum container;

a cathode for secondary electron emission comprising:

a base substrate; and a thin film formed on a surface of the base substrate and having a region for receiving an incident electron, the thin film comprising a material for emitting secondary electrons in response to the incident electron and including a plurality of particles, each having an average particle size of 200 nm to 2000 nm, which form convexities and/or concavities on the region; and an anode for collecting an electron emitted from the cathode for secondary electron emission, located inside of the vacuum container.

13. A photomultiplier tube comprising:

a vacuum container comprising a window for an incident light;

a cathode for photoelectric emission comprising:

a base substrate; and a thin film formed on a surface of the base substrate and having a region for receiving the incident light, the thin film comprising a material for emitting photoelectrons in response to the incident light and including a plurality of particles, each having an average particle size of 200 nm to 2000 nm, which form convexities and/or concavities on the region;

electron multiplier means for amplifying electrons emitted from the cathode for photoelectric emission, located inside of the vacuum container; and an anode for collecting electrons emitted from the electron multiplier means, located inside of the vacuum container.

* * * * *